US005288394A

United States Patent [19]

Lewis et al.

[11] Patent Number: 5,288,394

[45] Date of Patent: * Feb. 22, 1994

[54] PROCESS FOR THE PREVENTION OF POLYMER FORMATION IN COMPRESSOR SYSTEMS

[75] Inventors: Vincent E. Lewis; Carl T. Rowe, both of Missouri City, Tex.

[73] Assignee: Nalco Chemical Company, Naperville, Ill.

[ * ] Notice: The portion of the term of this patent subsequent to Nov. 3, 2009 has been disclaimed.

[21] Appl. No.: 907,320

[22] Filed: Jul. 1, 1992

Related U.S. Application Data

[63] Continuation-in-part of Ser. No. 718,623, Jun. 21, 1991, Pat. No. 5,160,425.

[51] Int. Cl.[5] ..... C10G 9/16

[52] U.S. Cl. ..... 208/48 AA; 208/47; 252/403; 252/405; 585/950

[58] Field of Search ..... 208/48 AA, 47; 252/403, 252/405; 585/950

[56] References Cited

U.S. PATENT DOCUMENTS

| | | | |
|---|---|---|---|
| 3,258,485 | 6/1966 | Argyle | 260/554 |
| 3,364,130 | 1/1968 | Barnum et al. | 208/48 |
| 3,679,765 | 7/1972 | Houston, Jr. et al. | 260/683 |
| 3,696,162 | 10/1972 | Kniel | 260/677 |
| 3,761,534 | 9/1973 | Sun et al. | 260/674 |
| 4,020,109 | 4/1977 | Fleck et al. | 260/601 |
| 4,628,132 | 12/1986 | Miller | 585/4 |
| 4,673,489 | 6/1987 | Roling | 208/289 |
| 4,952,301 | 8/1990 | Awbrey | 208/48 |
| 5,078,966 | 1/1992 | Strong et al. | 422/7 |
| 5,160,425 | 11/1992 | Lewis | 208/48 AA |

*Primary Examiner*—Mark L. Bell
*Assistant Examiner*—P. L. Hailey
*Attorney, Agent, or Firm*—Arnold, White & Durkee

[57] ABSTRACT

An improved process for inhibiting the formation and deposition of polymer-based fouling materials after caustic scrubbing of hydrocarbon streams contaminated with oxygenated compounds with a basic washing solution having a pH>7 comprising adding to the hydrocarbon stream after caustic scrubbing a sufficient amount for inhibiting formation and deposition of polymer-based fouling materials of a composition comprising at least one hydrazide compound characterized by the formula $$R-\overset{\overset{\displaystyle O}{\|}}{C}-NHNH_2$$

where R is selected from the group consisting of H, $NHNH_2$, and $$NHNH_2-\overset{\overset{\displaystyle O}{\|}}{C}-.$$

19 Claims, No Drawings

PROCESS FOR THE PREVENTION OF POLYMER FORMATION IN COMPRESSOR SYSTEMS

This application is a continuation-in-part of co-pending patent application Ser. No. 718,623, filed on Jun. 21, 1991, now U.S. Pat. No. 5,160,425.

BACKGROUND OF THE INVENTION

1. Field of the Invention

The present invention relates to an improved process for inhibiting the formation and deposition of polymer-based fouling materials after caustic scrubbing of gaseous or liquid hydrocarbon streams contaminated with oxygenated materials with a basic washing solution having a pH>7.

2. Background

Manufacture of ethylene and other olefins entails the use of pyrolysis or "cracking" furnaces to manufacture olefins from various gaseous and liquid petroleum feed stocks. Typical gaseous feed stocks include ethane, propane, butane and mixtures thereof. Typical liquid feed stocks include naphthas, kerosene, gas oil and crude oil.

In cracking operations, such as the pyrolytic cracking of ethane, propane, and naphtha to produce olefins, oxygenated compounds, including carbonyl compounds, are formed. The amount of carbonyl compounds, such as aldehydes and ketones, formed in such operations can vary widely, but is typically about 1-100 ppm in the hydrocarbon stream, with concentrations as high as 1000 ppm occasionally being encountered because of the utilization of various feed stocks and cracking temperatures.

Following cracking of the petroleum feed stock, the hydrocarbon effluent from the cracking furnace is subjected to a caustic, or basic, wash to remove various contaminants. Generally, this entails contacting in a caustic wash tower a basic washing solution (e.g., an aqueous solution having a pH>7) with a gaseous or liquid hydrocarbon stream to remove acidic components, such as hydrogen sulfide and carbon dioxide, and oxygenated compounds, such as carbonyl compounds. The oxygenated compounds, however, undergo polymerization in the presence of the caustic scrubbing or basic wash conditions. Deposition of the polymer leads to fouling. Eventually, depending on the polymer deposition rate, the unit must be shut down for cleaning—obviously a costly operation. Consequently, methods of preventing fouling, or at least significantly reducing the rate of fouling are constantly being sought. Basic wash systems which require treatment to inhibit polymer-based fouling include amine acid gas scrubbers (e.g., MEA, DEA, isopropyl amine, butyl amine, etc.) and caustic wash systems.

In particular, during ethylene production, the major component of the oxygenated compounds contaminating the ethylene effluent from the cracking furnace is acetaldehyde. The ethylene effluent from the cracking furnace, containing acetaldehyde, is washed in a caustic tower. On contact with a caustic solution, acetaldehyde undergoes multiple base catalyzed Aldol condensation reactions. This results in formation of a water insoluble polymer which can coat the surfaces of the caustic tower and reduce operation efficiency.

In some ethylene production units, an amine acid gas scrubber is used in front of the caustic tower to remove most of the acid gases. On contact with an amine solution, as on contact with a caustic solution, acetaldehyde undergoes base catalyzed Aldol condensation reactions. The result of these Aldol reactions is formation of a water insoluble polymer.

At some ethylene manufacturing facilities, a vinyl acetate plant is also present. Ethylene is used in the vinyl acetate production process. Unreacted ethylene is recovered by distillation and sent back through the ethylene unit fractionation train. Vinyl acetate can be entrained with the unreacted ethylene and enter the fractionation train. When vinyl acetate reaches the caustic tower it is hydrolyzed to produce a salt of acetic acid and vinyl alcohol. Vinyl alcohol tautomerizes to acetaldehyde, a source of the fouling polymer.

Current industry practice is to add specialty chemicals directly to the caustic tower to prevent or minimize formation of polymer-based fouling materials or aid in their removal from the tower.

However, caustic wash solutions can be entrained into the compressor section of an ethylene plant. Often, the caustic tower is located between two stages of the plant's compression section. For example, if the plant's compression section consists of four stages, the caustic tower may be located between the third and fourth stages. If a problem occurs in the caustic tower, foaming for example, caustic wash solution may be carried into the succeeding stage (the fourth stage in the example) of compression. It is known that approximately 20-30% of acetaldehyde which enters the caustic tower is distilled overhead and proceeds to the next stage of compression. Entrained caustic wash solution reacts with acetaldehyde which is carried into this succeeding stage of compression.

SUMMARY OF THE INVENTION

The present invention relates to an improved process for inhibiting the formation and deposition of polymer-based fouling materials after caustic scrubbing of gaseous or liquid hydrocarbon streams contaminated with oxygenated materials with a basic washing solution having a pH>7.

The method comprises adding to the hydrocarbon stream, after caustic scrubbing, e.g., at any stage of compression succeeding the caustic scrubbing process, a sufficient amount for inhibiting formation and deposition of polymer-based fouling materials of a composition comprising at least one hydrazide compound characterized by the formula $$R-\overset{\overset{\displaystyle O}{\|}}{C}-NHNH_2$$

where R is selected from the group consisting of H, $NHNH_2$, and $$NHNH_2-\overset{\overset{\displaystyle O}{\|}}{C}-.$$

Other features and advantages of the present invention will become apparent from the following detailed description, which is given by way of illustration only.

DETAILED DESCRIPTION OF THE INVENTION

In accordance with the present invention, a sufficient amount for inhibiting formation and deposition of polymer-based fouling materials of a polymerization inhibitor composition comprising at least one hydrazide compound is added to the hydrocarbon stream after caustic scrubbing with a basic washing solution, e.g., an aqueous solution having a pH>7. The hydrazide compounds employed in this invention are characterized by the formula $$R-\overset{\overset{\displaystyle O}{\|}}{C}-NHNH_2$$

where R is selected from the group consisting of H, $NHNH_2$, and $$NHNH_2-\overset{\overset{\displaystyle O}{\|}}{C}-.$$

Carbohydrazide, also known as carbazide and carbodihydrazide, has the formula, $H_2NNHCONHNH_2$, and is an especially preferred hydrazide compound.

The hydrazide composition of the present invention can be added to the hydrocarbon stream by any conventional method, e.g., as neat material or in solution form. The preferred method of addition is as an aqueous solution with 0.1 to 10 weight percent hydrazide present, with 6½ weight percent especially preferred, so that accurate metering of the inhibitor composition to the hydrocarbon stream can be achieved.

Theoretically, one mole of hydrazide is needed for every two moles of aldehyde, i.e., 0.5:1. However, ratios as high as 10 moles of hydrazide per mole of aldehyde may be required, i.e., 10:1. Preferably, the feed rate ranges from one to three moles of hydrazide per mole of aldehyde, with a 1:1 mole ratio being especially preferred.

The treatment should be added to the hydrocarbon stream after caustic scrubbing in sufficient quantity to assure that the molar amount of hydrazide is sufficient to react with all of the carbonyl contaminants. Treatment ranges of from 1 to 10,000 ppm of hydrazide per one million parts of olefin medium may be used if no convenient method of measuring carbonyl contents is available. The amount of aldehydes present in the hydrocarbon stream after caustic scrubbing, however, are typically on the order of 10–50 ppm. Therefore, the amount of hydrazide should be on this order of concentration. Specifically, treatment ranges of from 10 to 100 ppm of hydrazide in the hydrocarbon stream may be used. In any event, a sufficient amount of hydrazide for inhibiting formation and deposition of polymer-based fouling materials should be added to the hydrocarbon stream after caustic scrubbing.

Addition of the hydrazide composition after the caustic scrubbing provides greater likelihood of complete polymerization inhibition in succeeding plant processing units, such as succeeding stages of compression.

The following example compares the polymerization inhibiting performance of carbohydrazide and ethylenediamine.

EXAMPLE 1

A 200 g aliquot of 5% aqueous sodium hydroxide (400 mL beaker) was dosed at an appropriate level with the desired antifoulant. The beaker was placed in a pressure vessel capable of accommodating magnetic stirring. A stirring bar was added along with 1 mL of vinyl acetate, and the vessel was sealed. Nitrogen was introduced to reach a pressure of 75 psi; vigorous stirring was started and the vessel heated to 250° F. for six hours.

A 3 mL aliquot of 35% ethylenediamine in water was required to completely inhibit polymerization of a 1 mL aliquot of vinyl acetate. However, a 6 mL aliquot of 6½% carbohydrazide in water solution was required to inhibit polymerization of 1 mL of vinyl acetate.

The foregoing example demonstrates the superiority of the carbohydrazide polymerization inhibitor when added during the caustic wash.

Addition of the hydrazide composition in accordance with the present invention after caustic scrubbing provides even greater improvement in polymerization inhibition as a result of improved mixing and contact between oxygenated compounds, particularly acetaldehyde, contaminating the hydrocarbon stream and the hydrazide polymerization inhibitor composition in the succeeding plant processing units, such as a succeeding stage of compression.

The foregoing detailed description has been directed to particular embodiments of the invention for the purpose of illustration and explanation. It will be apparent, however, to those skilled in the art that modifications and changes in the compositions and methods set forth will be possible without departing from the scope and spirit of the invention. It is intended that the following claims be interpreted to embrace all such modifications and changes.

What is claimed is:

1. A method of inhibiting formation of polymeric fouling deposits after the caustic scrubbing of a hydrocarbon stream contaminated with oxygenated compounds with a basic washing solution having a pH>7 comprising adding to said hydrocarbon stream a sufficient amount for inhibiting formation and deposition of fouling materials of a composition comprising at least one hydrazide compound characterized by the formula $$R-\overset{\overset{\displaystyle O}{\|}}{C}-NHNH_2$$

where R is selected from the group consisting of H, $NHNH_2$, and $$NHNH_2-\overset{\overset{\displaystyle O}{\|}}{C}-.$$

2. A method according to claim 1 wherein said hydrocarbon stream is produced by pyrolytic cracking of hydrocarbon feedstocks.

3. A method according to claim 2 wherein said hydrocarbon feedstocks are selected from the group consisting of ethane, propane, butane, naphtha, and mixtures thereof.

4. A method according to claim 1 wherein said hydrocarbon stream is in a gaseous phase.

5. A method according to claim 1 wherein said hydrocarbon stream comprises at least one olefin.

6. A method according to claim 1 wherein said oxygenated compounds comprise carbonyl compounds.

7. The method according to claim 6 wherein said carbonyl compounds comprise aldehydes, ketones or mixtures thereof.

8. A method according to claim 1 wherein said at least one hydrazide compound is carbohydrazide.

9. A method according to claim 1 wherein said composition comprising at least one hydrazide compound is added to said hydrocarbon stream in an amount representing a molar ratio of hydrazide compound to oxygenated compound in the range of about 0.5:1 to about 10:1.

10. A method according to claim 9 wherein said composition comprising at least one hydrazide compound is added to said hydrocarbon stream in an amount representing a molar ratio of hydrazide compound to oxygenated compound in the range of about 1:1 to about 3:1.

11. A method according to claim 10 wherein said composition comprising at least one hydrazide compound is added to said hydrocarbon stream in an amount representing a molar ratio of hydrazide compound to oxygenated compound in the range of about 1:1.

12. A method of inhibiting the formation and deposition of fouling materials on the structural parts of hydrocarbon cracking equipment after caustic scrubbing with a basic washing solution having a pH>7 of a pyrolytically produced olefin contaminated with at least one carbonyl compound comprising adding to said olefin stream after said caustic scrubbing a sufficient amount for inhibiting formation and deposition of fouling materials of a composition comprising at least one hydrazide compound characterized by the formula $$R-\overset{\overset{\displaystyle O}{\|}}{C}-NHNH_2$$

where R is selected from the group consisting of H, $NHNH_2$, and $$NHNH_2-\overset{\overset{\displaystyle O}{\|}}{C}-.$$

13. A method according to claim 12 wherein said at least one carbonyl compound comprises an aldehyde, a ketone, or mixtures thereof.

14. A method according to claim 12 wherein said composition containing at least one hydrazide compound is added to said hydrocarbon stream in an amount representing a molar ratio of hydrazide compound to carbonyl compound of from about 0.5:1 to about 10:1.

15. A method according to claim 14 wherein said composition containing at least one hydrazide compound is added to said hydrocarbon stream in an amount representing a molar ratio of hydrazide compound to carbonyl compound of from about 1:1 to about 3:1.

16. A method according to claim 12 wherein said composition containing at least one hydrazide compound is added to said hydrocarbon stream in an amount representing a molar ratio of hydrazide compound to carbonyl compound of about 1:1.

17. A method according to claim 12 wherein said olefin is selected from the group consisting of ethylene, propylene, butadiene and mixtures thereof.

18. A method according to claim 17 wherein said olefin is in the gas phase.

19. A method according to claim 12 wherein said at least one hydrazide compound is carbohydrazide.

* * * * *